US009737133B2

(12) United States Patent
Hevlin et al.

(10) Patent No.: US 9,737,133 B2
(45) Date of Patent: Aug. 22, 2017

(54) DEVICE WITH EXPANDABLE CLEANING HEAD

(71) Applicants: Yiftach Hevlin, Karkom (IL); Omer Hevlin, Karkom (IL)

(72) Inventors: Yiftach Hevlin, Karkom (IL); Omer Hevlin, Karkom (IL)

( * ) Notice: Subject to any disclaimer, the term of this patent is extended or adjusted under 35 U.S.C. 154(b) by 0 days.

(21) Appl. No.: 15/034,601

(22) PCT Filed: Jan. 6, 2015

(86) PCT No.: PCT/IL2015/050026

§ 371 (c)(1),
(2) Date: May 5, 2016

(87) PCT Pub. No.: WO2015/104708

PCT Pub. Date: Jul. 16, 2015

(65) Prior Publication Data

US 2016/0278510 A1 Sep. 29, 2016

Related U.S. Application Data

(60) Provisional application No. 61/924,412, filed on Jan. 7, 2014.

(51) Int. Cl.
*A46B 5/00* (2006.01)
*A46B 7/02* (2006.01)
(Continued)

(52) U.S. Cl.
CPC ..... *A46B 5/005* (2013.01); *A46B 7/023* (2013.01); *A46B 9/023* (2013.01); *A46B 9/04* (2013.01);
(Continued)

(58) Field of Classification Search
CPC ..... A46B 5/005; A46B 7/02; A47L 13/24
See application file for complete search history.

(56) References Cited

U.S. PATENT DOCUMENTS 3,050,762 A * 8/1962 Ballinger ..... A47L 13/255 15/147.1
5,517,710 A * 5/1996 Hisey ..... A46B 5/0075 15/106
(Continued)

FOREIGN PATENT DOCUMENTS

CN 2603654 2/2004
CN 201029848 3/2008
(Continued)

OTHER PUBLICATIONS

International Search Report and Written Opinion for International Application PCT/IL2015/050026, dated May 17, 2015.
(Continued)

*Primary Examiner* — Randall Chin
(74) *Attorney, Agent, or Firm* — The Law Office of Joseph L. Felber

(57) ABSTRACT

The present invention relates to a cleaning device and in particular, to such a cleaning device that is adapted to having a controllable and expandable cleaning surface head. The expandable cleaning surface head is associated with a handle where movement in the vertical direction of the handle is adapted to horizontal movement that controls the size of cleaning surface head.

33 Claims, 7 Drawing Sheets

(51) Int. Cl.

| | |
|---|---|
| ***A47L 13/00*** | (2006.01) |
| ***A47L 13/24*** | (2006.01) |
| ***A47L 11/20*** | (2006.01) |
| ***A47L 13/22*** | (2006.01) |
| ***B44D 3/00*** | (2006.01) |
| ***E04H 4/16*** | (2006.01) |
| ***A46B 9/02*** | (2006.01) |
| ***A46B 9/04*** | (2006.01) |
| ***A47L 9/00*** | (2006.01) |
| ***A47L 13/11*** | (2006.01) |
| ***A47L 13/20*** | (2006.01) |
| ***B05C 17/02*** | (2006.01) |

(52) U.S. Cl.

CPC ..... *A47L 9/009* (2013.01); *A47L 11/20* (2013.01); *A47L 13/00* (2013.01); *A47L 13/11* (2013.01); *A47L 13/20* (2013.01); *A47L 13/22* (2013.01); *A47L 13/24* (2013.01); *B05C 17/024* (2013.01); *B44D 3/00* (2013.01); *E04H 4/1636* (2013.01); *A46B 2200/302* (2013.01)

(56) References Cited

U.S. PATENT DOCUMENTS 6,088,868 A * 7/2000 Cerveny ..... A46B 5/0033 15/144.1
7,350,258 B2 * 4/2008 Jones ..... A47L 13/24 15/106

FOREIGN PATENT DOCUMENTS

| | | |
|---|---|---|
| CN | 201234958 | 5/2009 |
| CN | 201404167 | 2/2010 |
| CN | 201558063 | 8/2010 |
| CN | 202288169 | 7/2012 |
| FR | 2.224.113 | 10/1974 |
| KR | 200198351 | 10/2000 |
| KR | 20-0312437 | 5/2003 |
| WO | 2005/016067 | 2/2005 |

OTHER PUBLICATIONS

International Preliminary Report on Patentability for International Application PCT/IL2015/050026, dated Mar. 29, 2016.

* cited by examiner 100
102
102a
102b
104
104p
104r
104r,105
104b
104c
105
105a
105b
10
10U
20
20L
20R
110m
112
114
115

DEVICE WITH EXPANDABLE CLEANING HEAD

RELATED APPLICATIONS

This application claims priority from U.S. provisional patent application No. 61/924,412 filed Jan. 7, 2014, entitled "VARIABLE-WIDTH SWEEPING TOOL," the entire contents of which are herein incorporated by reference.

FIELD OF THE INVENTION

The present invention relates to a cleaning device and in particular, to a cleaning device such as a squeegee, mop or broom that are adapted to having a controllable and expandable cleaning head.

BACKGROUND OF THE INVENTION

The present invention relates to cleaning devices in the form of a broom, floor wiper, mop, squeegee, vacuum cleaner, or the like. Such cleaning devices are characterized by a horizontally oriented cleaning head that is attached to a handle that is usually provided in the form of a long vertical stick. The head portion is configured to clean a surface generally in the horizontal plane in a direction perpendicular to the long axis of the cleaning head.

Typically, in the case of a broom, the bottom side of the head comprises the cleaning surface usually in the form of bristles, hair or the like; in a mop it comprises a water-holding and/or absorbing material, such as a sponge or a plurality of fibers, cloth and in a floor wiper or squeegee it typically comprises a cloth, flexible strip, made of rubber or similar substance.

The width of the cleaning head of the cleaning device is generally its longer dimension. Accordingly this width of the cleaning head directly relates to the surface that may be cleaned with a sweep that may be affected at any one time. The sweep size is determined as a compromise between two considerations. On the one hand it is desirable to make the cleaning head relatively wide, so that fewer sweeps are needed to cover a given floor area. On the other hand, it is often desired to have a narrow cleaning head, so as to be able to sweep narrowly bounded sections of a floor, such as under furniture or in narrow niches. The latter need is particularly pronounced in homes and in offices and therefore most sweeping tools commonly used in such premises have relatively narrow cleaning heads. This may be contrasted to sweeping tools that are designed for industrial and commercial applications, whose heads are relatively wide, for example street sweeper. Yet it may often be desirable to have a sweeping tool, to be employed in homes or offices, whose head can be selectively wide and narrow; it may even be more desirable that the length of the head be settable by its user in a plurality of widths—possible in a continuum of widths between two extreme values, minimum width and maximum width.

SUMMARY OF THE INVENTION

China Utility Model Publication No. CN202288169 U to Univ Shandong Scient & Tech and China Patent Application No. 2603654 Y to YINGJIE ENTPR CO. Ltd, teach a device having an expandable head where the expandable surfaces are arranged in a stackable formation, one on top of the other.

There is an unmet need for, and it would be highly useful to have, a cleaning device where the width of the cleaning head surface is controllable and may readily assume a wide conformation or a narrow conformation and may assume any size therebetween.

The present invention is generally of a variable-width cleaning device, such as a mop, squeegee, sweeper or broom, comprising a vertical handle portion and a horizontal head portion, the head portion having variable width. The head portion comprises a cleaning surface that may be controllably expanded or retracted to assume variable widths form a narrow cleaning head to a wide cleaning head, or widths therebetween.

The variable width cleaning device is characterized in that the vertical handle provides for controlling the width of the horizontal cleaning head. Specifically the cleaning device of the present invention is characterized in that movement of a portion of the handle along the vertical axis (Y-axis) leads to expansion or retraction of the cleaning head in the horizontal axis (X-axis) or plane allowing the cleaning head to assume variable widths including a wide or narrow configuration.

Within the context of this application the term cleaning surface refers to that part of a cleaning device such as a broom or mop that is actively used to undertake cleaning. Optionally the cleaning surface may take optional forms for example including but not limited to broom bristles, mop head, cloth, sweeper cloth, static charged cleaning cloth, water retention cloth, water retention fabric, squeegee, squeegee rubber, absorbing material, sponges, polymers, plastic, cleaning pad, abrasive cleaning pad, metallic abrasive cleaning pad, the like, or any combination thereof.

Within the context of this application the term vertical axis may be interchangeable refer to the axis along a handle portion of the cleaning device, and generally refers to the Y-Axis governing the up and down direction.

Within the context of this application the term horizontal axis or plane may be interchangeable refer to the axis along a cleaning head portion of the cleaning device, and generally refers to the X-Axis governing the right to left direction.

Unless otherwise defined, all technical and scientific terms used herein have the same meaning as commonly understood by one of ordinary skill in the art to which this invention belongs. The materials, methods, and examples provided herein are illustrative only and not intended to be limiting.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE PREFERRED EMBODIMENTS

The principles and operation of the present invention may be better understood with reference to the drawings and the accompanying description. The following figure reference labels are used throughout the description to refer to similarly functioning components are used throughout the specification hereinbelow.

| | |
|---|---|
| 10 | vertical axis or Y-axis; |
| 20 | horizontal axis or X-axis; |
| 100 | cleaning device; |
| 102 | handle assembly; |
| 102a | handle first portion; |
| 102b | handle second portion; |
| 102e | extended second portion; |
| 104 | adaptor assembly; |
| 104b | adaptor plate upper surface; |
| 104c | adaptor plate rod recess; |
| 104p | adaptor assembly plate; |
| 104r | adaptor assembly rods; |
| 105 | rod shaft; |
| 105a | rod shaft first end; |
| 105b | rod shaft second end; |
| 106 | interface assembly; |
| 106a | interface first portion; |
| 106b | interface second portion; |
| 106c | interface connector/coupler; |
| 110 | cleaning head assembly; |
| 110a | upper surface; |
| 110b | body; |
| 110c | lower surface; |
| 110m | cleaning medium/surface; |
| 112 | cleaning head first (right) portion; |
| 112a | long arm; |
| 112b | base; |
| 112c | short arm; |
| 112o | long arm outer edge; |
| 112i | long arm inner edge; |
| 112d | short arm outer edge; |
| 112e | short arm inner edge; |
| 112o | outer edge; |
| 112r | rail; |
| 112t | track; |
| 114 | cleaning head second (left) portion; |
| 114a | long arm; |
| 114b | base; |
| 114c | short arm; |
| 114o | long arm outer edge; |
| 114i | long arm inner edge; |

-continued

| | |
|---|---|
| 114d | short arm outer edge; |
| 114e | short arm inner edge; |
| 115 | unitary cleaning head; |
| 115a | long edge; |
| 115b | short edge; |
| 116 | cleaning head stationary central portion; |
| 120 | interchangeable cleaning head; |
| 120r | cleaning head coupling recess; |
| 150 | auxiliary electronic devices; |

Figure 1:
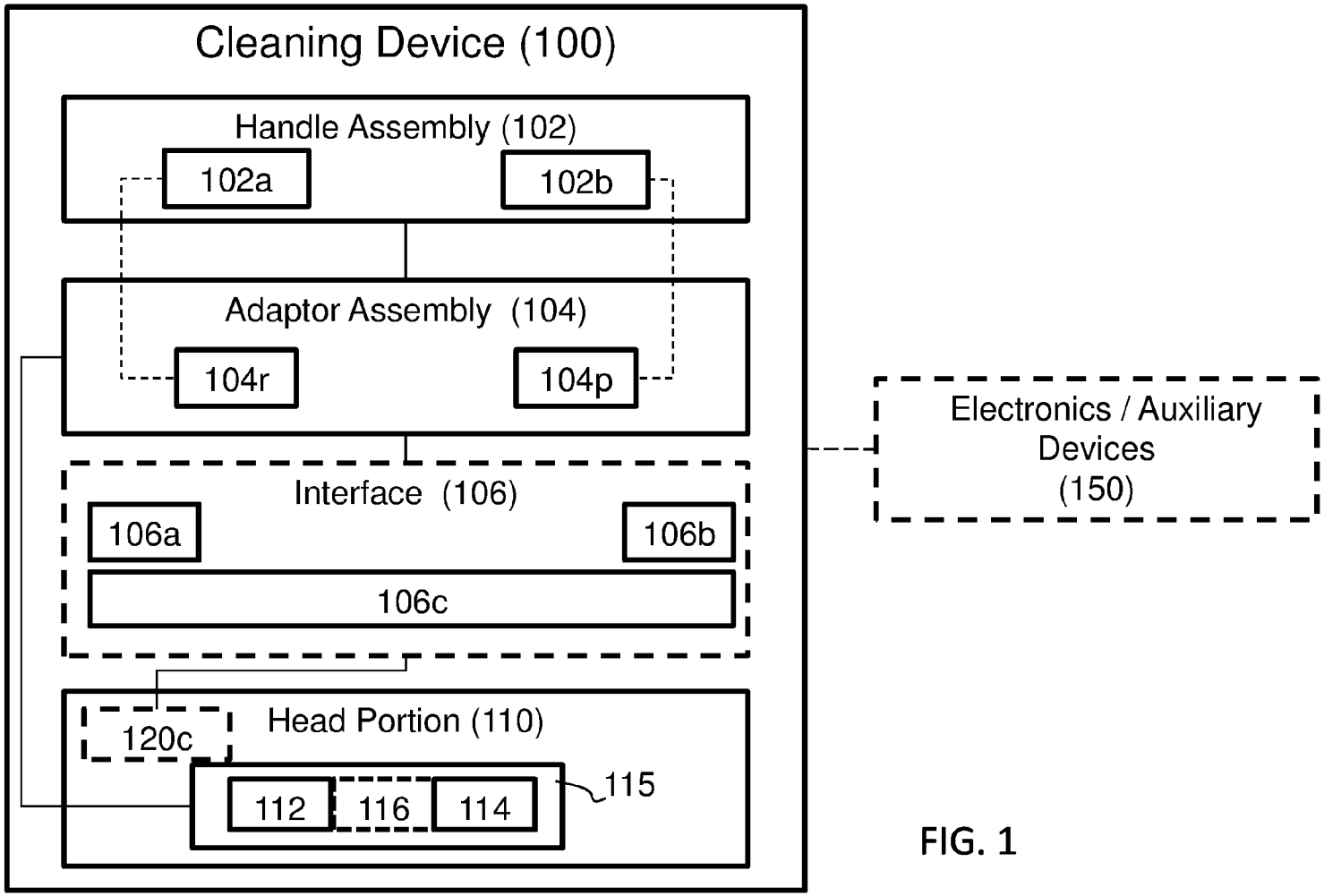
FIG. 1 is a schematic block diagram of a cleaning device according to the present invention.

FIG. 1 shows a schematic block diagram of an optional embodiment of the present invention for a cleaning device 100 that features a head portion 110 provided for cleaning and/or treating a surface, the device 100 is characterized in that the size of the head portion 110 is controllable along at least one dimension. Most preferably the head portion 110 of the device may assume at least two or more size configuration along at least one dimension for example length and/or width, where for example the head portion 110 may be selectively and controllably made to be narrow at its minimal configuration and/or wide at its expanded maximal configuration. Optionally and preferably head portion 110 may assume any size within the range of the minimized and maximized configurations.

Device 100 provides for controlling the size of the head portion 110 along at least one dimension by employing a handle assembly 102 and an adaptor assembly 104 that are functionally associated with the head portion 110. Most preferably the handle assembly 102 provides a handle that may be moved in the vertical direction 10 which is adapted and/or converted and/or translated by adaptor 104 to provide head portion 110 with the necessary horizontal movement in the horizontal plane and axis 20 to allow head portion 110 to assume a small configuration (narrow) or an expanded configuration (wide) configuration.

The ability to change the size of a head portion 110 in a controllable manner with handle portion 102 that may be maneuvered vertically in the vertical axis is advantageous as a user may seamlessly expand or retract the cleaning head 110 along the horizontal axis, and in particular without having to touch or come into direct physical contact with the cleaning head 110.

Optionally cleaning device 100 may be realized in a variety of forms for example including but not limited to a brush, broom, mop, squeegee, sweeper, the like or any combination thereof.

Cleaning device 100 preferably comprises a handle assembly 102, adaptor assembly 104, and head portion 110. Optionally device 100 may further comprise an interface assembly 106 that facilitates to couple the adaptor assembly 104 with interchangeable head portions 120, a variant form of head portion 110 as will be discussed below with respect to FIG. 3A-D.

Figures 2A, 2B, 2C:
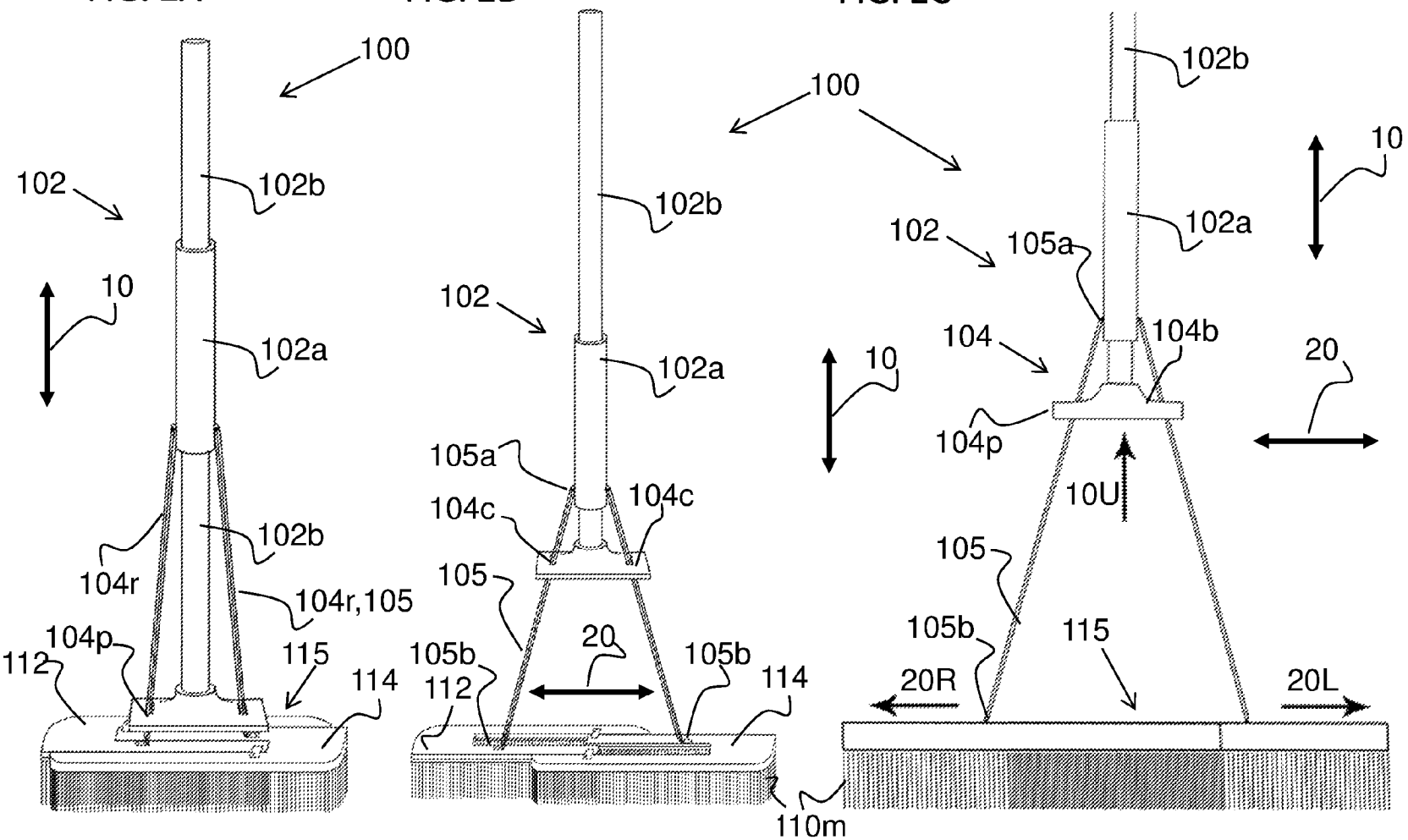
FIG. 2A-C are schematic illustrative diagrams of an exemplary cleaning device, depicted in the form of a broom, according to an optional embodiments of the present invention.

Handle assembly 102 preferably comprises a first portion 102*a* and a second portion 102*b* that are concentrically associated with one another where second portion 102*b* is disposed internal to first portion 102*a*, for example a shown in FIG. 2A-C. Therefore first handle portion 102*a* may be maneuvered vertically along the length of second portion 102*b*.

Most preferably handle assembly 102 is functionally coupled with a portion of adaptor assembly 104, such that the maneuvering of handle first portion 102*a* in the vertical direction mobilizes adaptor assembly 104.

Adaptor assembly 104 preferably comprises two portions: a plate portion 104*p* and at least two rods 104*r*. Preferably rods 104*r* are pivoted by way of a hinge, folding crease coupler, or the like pivoting connectors with first handle portion 102*a*. Preferably pivoting rod 104*r* with first handle portion 102*a* allows for transferring the motion and position of handle portion 102*a* to the adaptor assembly 104. Preferably plate portion 104*p* provides for receiving at least a portion of rod 104*r* along the length of rods 104*r*, 105 and provides for directing and/or limiting and/or controlling the movement of rods 104*r*. Plate portion 104*p* is preferably coupled with second handle portion 102*b* therein further providing for transferring vertical motion with handle assembly 102 to adaptor assembly 104.

Adaptor assembly 104 may optionally be coupled with at least one of head assembly 110 or an optional interface assembly 106.

In an optional embodiment, adaptor assembly 104 may be functionally and directly coupled to an interface assembly 106 that functions to receive the horizontal movement provided by assembly 104. Preferably interface assembly comprises at least two or more portions 106*a*, 106*b* that are configured to couple with optional configurations of head portions 110, for example in the form of interchangeable head portions 120, shown in FIG. 3A-D. Interface assembly 106 is preferably coupled to head portion 110, 120 with optional coupler 106*c* that is configured to couple with corresponding couplers provided on head portion 110, 120.

Most preferably interface assembly 106 provides for allowing a user to quickly and seamlessly interchange head portions so as to allow the handle assembly 102 to be readily coupled with different and/or interchangeable head portions 110,120 therein providing a cleaning device that may be realized in optional forms for example including but not limited to a mop, broom, squeegee, sweeper as depicted by the type of head portion 110,120 that is utilized.

In an optional embodiment, adaptor assembly 104 may be functionally and directly coupled to head portion 110 that functions to receive the horizontal movement provided by assembly 104. Optionally as described above head portion 110 may be associated with adaptor assembly 104 indirectly via interface assembly 106. Optionally head portion 110 may be coupled to adaptor assembly.

Optionally head portion 110 and adaptor assembly 104 may be coupled with one another over a fixed and/or rigid coupling apparatus, such as welding and/or bolt and/or screw, in such a manner wherein head portion 110 defines the type of cleaning device 100 that is provided. For example, device 100 may be realized as a broom when portions of head portion 110, provided in the form of a broom head, are screwed and/or bolted and/or welded with portions of the adaptor assembly 104, to allow horizontal motion but fixing the type of cleaning head that is available to the end user.

Figure 5:
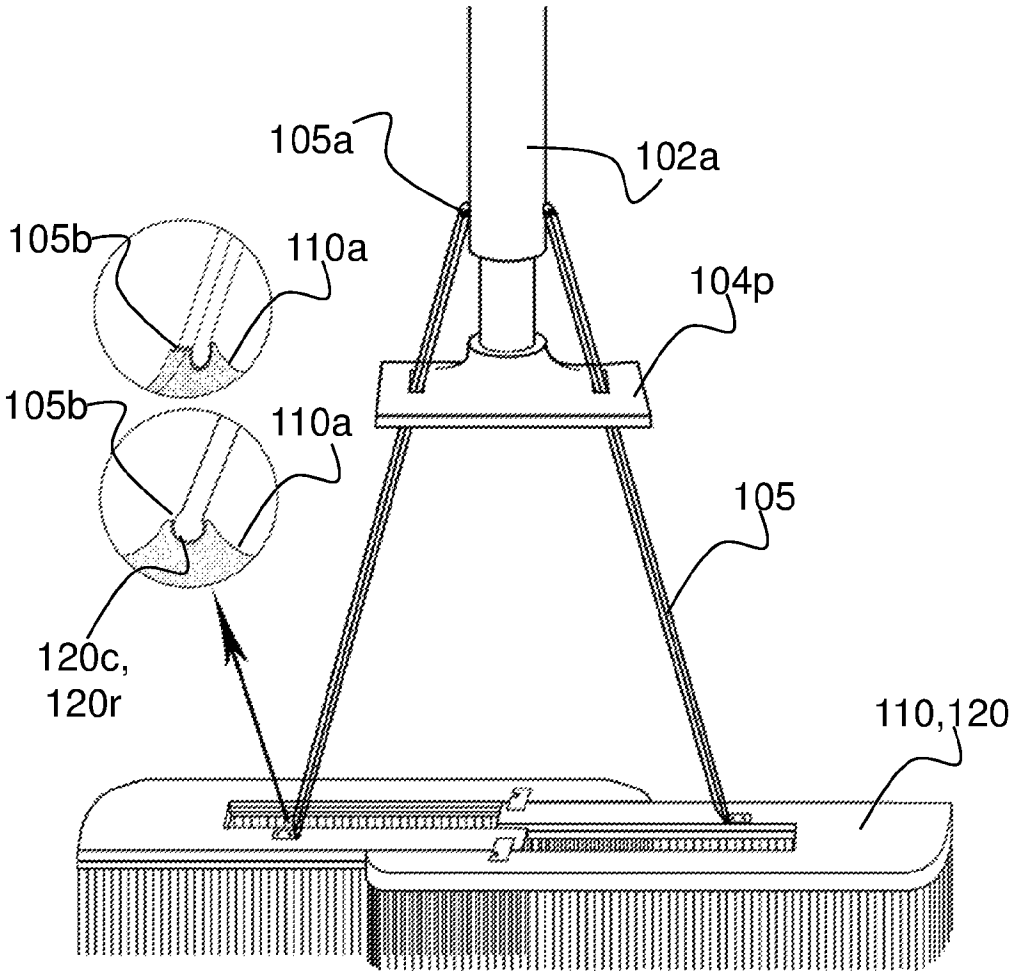
FIG. 5 is a schematic illustrative diagram of an exemplary cleaning device according to an optional embodiments of the present invention.

Optionally head portion 110 and adaptor assembly 104 may be securely coupled with one another by way of utilizing a non-rigid and/or readily removable couplers for example including but not limited to male-female couplers, snap fit couplers, hook and look couplers, or the like coupling apparatus so as to allow adaptor assembly to interchange the type of head portion 110 utilized, for example as depicted in FIG. 5.

Head portion assembly 110 preferably comprises at least two or more head portions 112, 114 that are intertwined and slideable relative to one another to form a unitary cleaning head 115 that may assume variable width along the long side of cleaning head 115 to provide a range of width ranging from a narrow (small) configuration, FIG. 2A, to a wide (long) configuration, FIG. 2C.

Optionally head portion 112 is configured to be a right handed portion and head portion 114 is a left handed portion that are configured to fit and intertwined with one another to form a unitary cleaning head 115. Optionally portions 112, 114 may be configured to be geometric chiral bodies providing for fitting in a handshake configuration, for example as shown in FIG. 4A.

The two head portions 112, 114 are configured to slide relative to one another, along the respective inner edge (112*i*,114*i*) of each of the two corresponding head portion 112,114, configured to allow each head portion to slide along the inner edge in the horizontal direction 20 in to the right 20R or the left 20L direction when handle assembly is manipulated along the horizontal axis, for example as shown in FIG. 2C.

Optionally head portions 112,114 may be fits with corresponding track and rail so as to facilitate their movement relative to one another in opposite direction along the horizontal axis 20.

Head portion 110 is coupled to handle portion 102 via adaptor 104. Most preferably head portion 110 is coupled to adaptor 104 utilizing rod shaft 105 that is directdly attached to any portion of head portion 110 for example including but not limited to an upper surface, lower surface, a side surface, an inner side surface, an outer side surface, or any combination thereof. More preferably head portion 110 is coupled with rod shaft 105 of adaptor assembly 104 along an upper surface of head portion 110 or side surface of head portion 110.

Optionally each head portion 112,114 forming head portion assembly 110 may be coupled with an individual rod shaft 105 along any surface selected from an upper surface, lower surface, a side surface, an inner side surface, an outer side surface, or any combination thereof. More preferably each of head portion 112,114 may be directly coupled with an individual rod shaft 105 along either an upper surface or a side surface.

Optionally each head portion 112, 114, and stationary central head portion 116 may be fit with corresponding track and rail system so as to allow them associate and slide relative to one another.

Optionally unitary cleaning head 115 may be provided from at least three sub-portions including a right portion 112 capable of moving along the right horizontal axis, a left portion 114 configured to move along the left horizontal axis, and a stationary central portion 116 and left portion 114 moves to the left relative to the stationary central portion 116. Optionally right portion 112 is configured to slide relative to stationary central portion 116 and left portion 114 is configured to slide relative to stationary central portion 116. Preferably right portion 112 may couple and/or associate on the right side of stationary central portion 116 and left portion 114 may couple and/or associate on the left side of stationary central portion 116 to form unitary cleaning head 115.

Figure 6B:
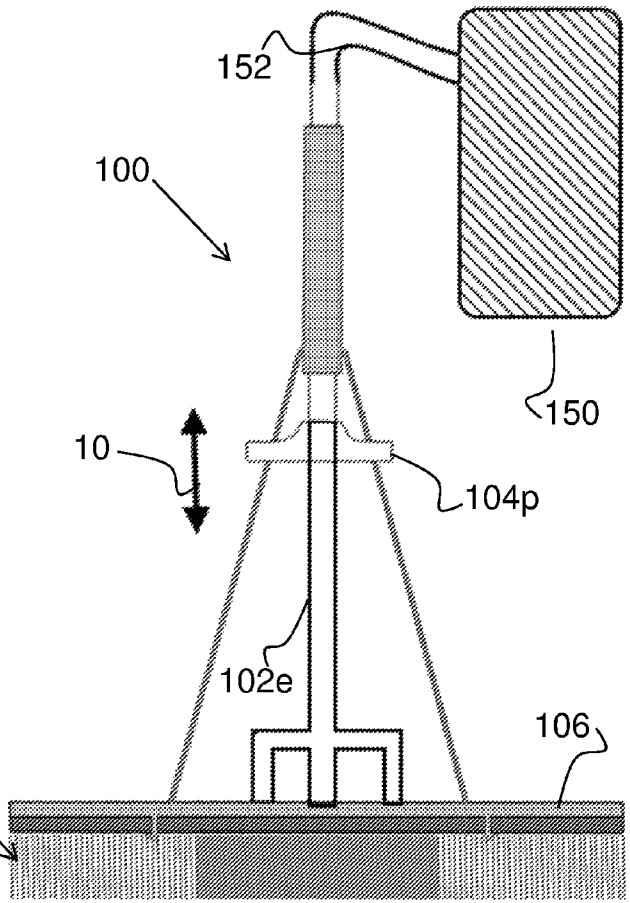
FIG. 6A-B are schematic illustrative diagrams of exemplary cleaning device that is utilized with an auxiliary electronic devices according to an optional embodiments of the present invention.
Figure 6A:
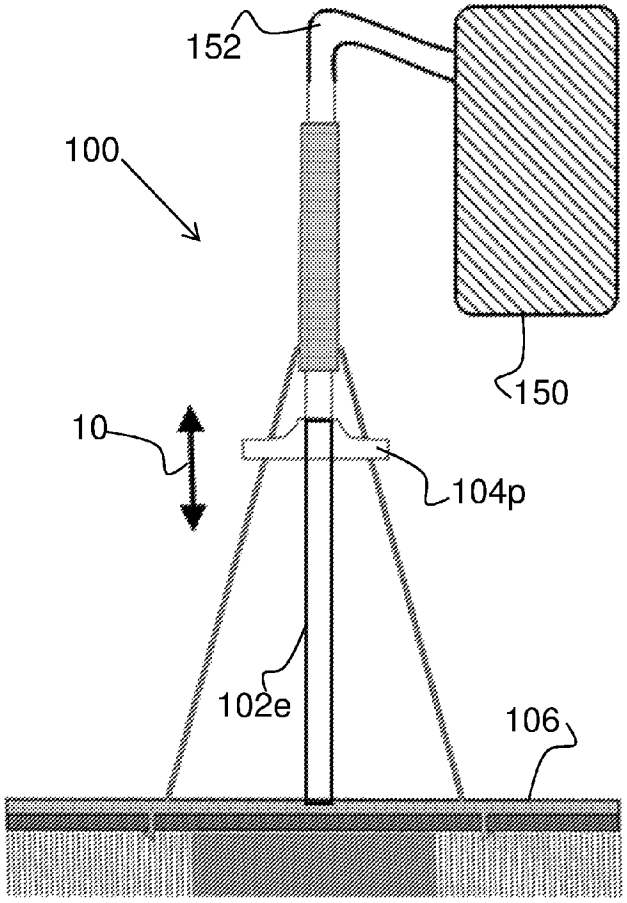

An optional embodiment may provide for coupling device 100 with optional auxiliary devices and/or electronic devices 150, for example as shown in FIG. 6A-B. Preferably handle assembly 102, and in particular handle second portion 102*b*, may be configured to be coupled with a portion of optional auxiliary device and/or electronic devices 150, having a hose or tubing that conveys a flowing fluid for example air, liquid, emulsion or gas wherein the hose may be coupled with a handle assembly 102, for example at handle second portion 102*b*, so as to convey the flowing fluid to the cleaning head assembly 110.

Optional auxiliary electronic devices (150) may be selected from the group for example including but not limited to: vacuum cleaner, steam cleaner, pool cleaning device, pool vacuum cleaner, electronic painting device, spray paint gun, electric paint roller, electric paint brush, the like or any combination thereof.

Accordingly device 100 may be configured to be an add-on device and/or a retrofit device onto an existing auxiliary and/or electronic system 150 for conveying a flowing fluid via a hose. For example a device 100 may be configured to fit with an off the shelf vacuum cleaner so as to provide an extension member and/or cleaning head and arm capable of assuming variable cleaning head widths.

Now referring to FIG. 2-6 showing detailed depiction of optional embodiments of device 100, according to the present invention where similar parts are labelled accordingly throughout. While the images depicted show device 100 configured in the form of a broom using a head portion (110) in the form of a broom head, the present invention is not limited to such an application where as discussed the head portion 110 may be provided in a variety of optional forms for example including but not limited to squeegee, brush, paint brush, hair brush, sweeper, mop, broom, water retention cloth, static charged cleaning cloth, water retention fabric, street sweeper, rake, garden rake, the like or any combination thereof.

FIG. 2A-C show an optional embodiment of device 100 comprising a handle portion 102, that is coupled with adaptor portion 104, that is in turn directly affixed to head portion 110. Device 100 is configured to transform vertical movement of a portion of handle portion 102 in the vertical axis 10 to control the width of head portion 110 in the horizontal axis 20 therein allowing device 100 to be realized in various configuration based on its width, for example as shown, a narrow configuration as shown in FIG. 2A, a wide configuration as shown in FIG. 2C, and an intermediate width configuration as shown in FIG. 2B.

Preferably handle assembly 102 comprises at least two members 102*a*,102*b* that are concentrically fit with one another so as to allow a user to vertically slide first handle portion 102*a* relative to second handle portion 102*b*. The second handle portion 102*b* is disposed internally with first handle portion 102*a* and may slide relative to one another for example as shown by directional arrows 10 depicting the vertical axis.

Most preferably each of first handle portion 102*a* and second handle portion 102*b* are individually attached to a portion of adaptor assembly 104, as will be described in greater detail below.

Optionally and preferably handle portion 102 may be provided in the form of an elongated cylindrical rod or the like shape conducive for holding, wherein first portion 102*a* has an open central channel along its length that is configured to receive second portion 102*b*.

Optionally handle portion 102 and its parts may be provided from optional materials as is known in the art for example including but not limited to polymers, alloys, metals, plastics, natural fibers, wood, recycled materials, the like or any combination thereof.

Optionally and preferably the length second handle portion 102*b* may be configured to be at least twice the length of first handle portion 102*a*.

Optionally the length of second handle portion 102*b* may be at least three times the length of the first handle portion 102*a*.

Optionally handle assembly 102 may feature at least two or more integrated stopping positions (not shown) provided to limit the movement of first handle portion 102*a* over second handle portion 102*b*.

The stopping position may be realized in the form of latch and recesses that are disposed along the length of first handle portion 102*a* and along at least a portion of the second handle portion 102*b*, that corresponds and interfaces with first handle portion 102*a*.

Optionally first handle portion 102*a* may comprise a plurality of recesses provided as stopping points and second handle portion 102*b* may feature a latch that may be repositioned between the plurality of recesses.

Preferably each of first handle portion 102*a* and second handle portion 102*b* are configured to securely fit with adaptor assembly 104, that comprises a plate member 104*p* and at least one rod member 104*r* and more preferably at least two rod members 104*r*.

Adaptor assembly plate member 104*p* is a substantially rectangular body including two parallel long edges, two parallel short edges and an upper surface 104*b*, FIG. 2C. Upper surface 104*b* is optionally and preferably configured to receive and securely couple with an end second handle portion 102*b*, for example as shown.

Optionally plate 104*p* and handle second portion 102*b* may be coupled by way of corresponding couplers that may for example be selected from the group including but not limited to: threading, male to female connectors, snap fit and recess connectors, latch and recess, the like or any combination thereof.

Preferably adaptor plate 104*p* further features at least two parallel recesses 104*c*, FIG. 2B, provided through the adaptor plate surface. The at least two parallel recess 104*c* are preferably disposed adjacent to the two parallel short edges of plate 104*p*. Each recess 104*c* is provided for receiving at least a portion of an adaptor assembly rod 104*r* along its length 105. Recess 104*c* is further configured to facilitate and allow plate 104*p* to slide along rod 104*r* about its length 105. Such sliding provides for facilitating adapting and/or converting the vertical movement 10U of handle assembly 102 along vertical axis 10 to horizontal movement 20R, 20L along the horizontal axis 20, FIG. 2C, to allowing the head portion 110 of device 100 to assume a plurality of optional configurations as shown FIG. 2A-C.

Optionally the two parallel recesses 104*c* may be provided in the form of a borehole across the surface of adaptor plate 104*p*. Optionally recess 104*c* may be provided with an angle across plate 104*p*. Optionally recess 104*c* angle may be up to about 90 degrees relative to a normal of plate upper surface (104*b*).

Preferably the at least two rod members 104*r* are configured to securely associate with the first handle member 102*a*, for example as shown FIG. 2A-C.

Preferably the two adaptor assembly rods 104*r* are substantially provided in the form of cylindrical rods having a first end 105*a*, an elongated shaft 105 and a second end 105*b*.

Preferably rod shaft 105 is configured to be received within adaptor plate 104*p* along recess 104*c*.

Preferably rod first end 105*a* is configured to be pivotally coupled with first handle portion 102*a*, wherein rod 104*r* is pivoted with respect to first handle portion 102*a* over a hinge coupler allowing rod 104*r* to assume variable angles relative to the shaft of first handle portion 102*a*. Most preferably the angle assumed by rod 104*r* relative to first handle portion 102*a* is limited and/or controlled with plate member 104*p* and more particularly by recess 104*c*.

Most preferably two rods 104*r* are coupled with first handle portion 102*a* on opposite sides of handle portion 102*a*.

Optionally the pivotal coupling between rod first end 105*a* and first handle portion 102*a* may be mediated with a coupler selected from the group for example including but not limited to: a hinge, ball and socket joint, creasing, folding crease, soft crease, the like or any combination thereof.

Preferably rod second end 105*b* is configured to associate with a cleaning head portion 110. As shown, the second end 105*b* of a first rod member 104*r* is coupled with right hand head portion 112 and the second end 105*b* of a second rod member 104*r* is coupled with left hand head portion 114, therein providing for the simultaneous movement of the right hand head portion 112 to move horizontally to the right 20R, while simultaneously left hand head portion 114 moves horizontally to the left 20L, for example as shown in FIG. 2C. Most preferably movement along the horizontal axis 20 is controlled by the vertical movement, depicted by arrow 10U, wherein second handle portion 102*b* is displaced vertically upwards (10U) relative to first handle portion 102*a*.

Optionally adaptor assembly 104 may further define a plurality of stopping points (not shown) for controlling the movement of plate 104*p* along rods 104*r* and therein controlling the movement in the horizontal axis 20. Optionally the stopping points may be realized in the form of notches and/or graduations disposed on rods 104*r* along its length 105, while adaptor plate 104*p* may be fit with a stopping and/or or holding member (not shown) provided to hold said plate 104*p* at a stopping points along the rods shaft 104*r*, 105. Optionally the stopping points associated with plate 104*p* may be provided within recess 104*c*. Optionally plate 104*p* may be provided with a clamping member (not shown) disposed along one of its surfaces or edges to catch and/or prevent plate 104*p* from sliding along rods 104*r* Adaptor assembly 104 is provided for translating and/or converting the vertical movement provided by handle assembly 102 to horizontal movement 20 of cleaning head assembly 110 so as to provide a controllable cleaning area.

Preferably cleaning head assembly 110 comprises at least two cleaning head portions 112, 114 that are coupled with one another to form a unitary cleaning head 115 having at least one variable dimension along the horizontal axis and/or plane 20. Most preferably the variable dimension is controllable with the movement of handle assembly 102 along the vertical axis 10.

As best seen in FIG. 4A-D, unitary cleaning head 115 includes: a planar body 110*b* comprising an upper surface 110*a* and a lower surface 110*c*. The upper surface 110*a* is provided for associating with said adaptor assembly 104, preferably at second end 105*b* as shown in FIG. 2B-C. Lower surface 110*c* provides a surface for receiving and/or housing and/or integrating with a cleaning medium 110*m*, a non limiting example is shown in the form of broom brush bristles FIG. 2A-C. Optionally, cleaning medium 110*m* may for example include any medium utilized for cleaning a surface but is not limited to a medium selected from the group consisting of: broom brush bristles, squeegee rubber, mop fibers, water retention fibers, water retention cloth, floor wiper cloth, brush fibers, absorbing material, sponges, polymers, plastic, rubber, cleaner pad, abrasive cleaning pad, metallic abrasive pads, polymer cleaner pad, natural fiber cleaning pad, the like or any combination thereof.

Optionally device 100 and in particular adaptor assembly 104 may be further configured to provide the unitary cleaning head 115 with at least one variable dimension in a dimension for example including but not limited to the dimension selected from: long side, short side, length, width, diameter, radius, the like or any combination thereof.

While unitary cleaning head 115 is depicted as having a rectangular body, however cleaning head 115 is not limited to such a rectangular form. Optionally the body 110*b* of unitary cleaning head 115 may assume any geometric shape for example including but not limited to a geometric shape selected from the group comprising: rectangle, rounded rectangle, quadrilateral, oval, circular, ovoid, ellipsoid, polygon having n sides where n is at least 3 (n>2), the like or any combination thereof. Now collectively referring to FIG. 4A-D and FIG. 2A-C, showing a specific however non-limiting embodiment of unitary cleaning head 115 according to the present invention. Unitary cleaning head 115 may be provided with a rectangular body 110*b* including a long edge 115*a* and a short edge 115*b*, wherein the variable dimension 115*d* is width corresponding to the length of the long edge 115*a* characterized in that the at its wide configuration, FIG. 2C, unitary cleaning head 115 has a length equal to about twice the length of long edge 115*a*; at in its narrow configuration, FIG. 2A, cleaning head 115 has a length equal to about the length of long edge 115*a*; at an intermediate length, FIG. 2B, the width of cleaning head 115 is in between the narrowest configuration and widest configuration larger than the length of long edge 115*a* and shorter than twice the length of long edge 115*a*.

Figure 4B:
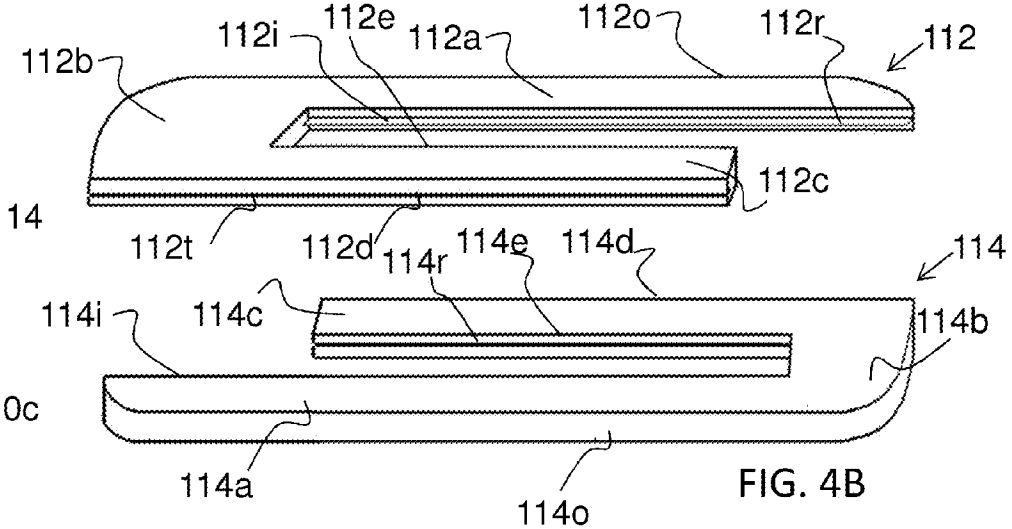
FIG. 4A-D are schematic illustrative diagrams of an exemplary cleaning device head portion according to an optional embodiments of the present invention.
Figure 4A:
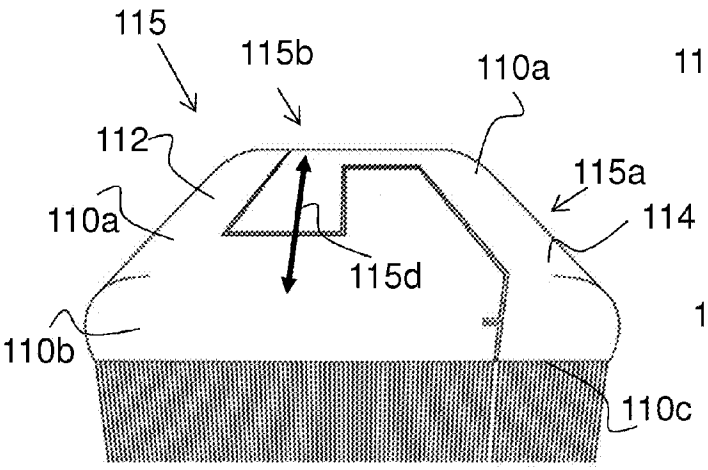

FIG. 4A-B, show unitary cleaning head 115 comprises at least two cleaning head portions 112,114 include a right hand cleaning head 112 and a left hand cleaning head 114. The cleaning head portions 112,114 are characterized in that the right hand cleaning head portion 112 and the left hand cleaning head portion 114 may be intertwined and/or slidingly fit with one another, so as to form a handshake coupling between right portion 112 and left portion 114.

As shown in FIG. 4B showing a partial exploded view of FIG. 4A. The two cleaning head portions 112,114 are geometric chiral bodies of the other, each portion forming 'U-like' polygonal body comprising a rectangular base 112*b*, 114*b* integral with two extending arms including a long arm 112*a*,114*a* and a short arm 112*c*, 114*c*.

The long arm 112*a*, 114*a* having an outer edge 112*o*,114*o* and an inner edge 112*i*,114*i*.

The short arm 112*c*, 114*c* comprising an outer edge 112*d*,114*d* and an inner edge 112*e*,114*e*.

Preferably the right portion 112 and left portion 114 are configured to intertwine and/or fit with one another in a manner depicted as follows: the long arm inner edge 112*i*, 114*i* is configured to slidingly interface and/or associate with the short arm outer edge 112*d*,114*d* of the corresponding cleaning head portion; and the short arm inner edge 112*e* is configured to slidingly interface and/or associate with the corresponding short arm inner edge 114*e* of the corresponding cleaning head portion.

Optionally and preferably the at least two cleaning head portions 112, 114 are slidingly associated with one another by way of utilizing corresponding track and rail system.

Optionally the inner edge 112*i*, 114*i* of long arms 112*a*, 114*a* comprises a rail 112*r*,114*r* extending from the inner edge surface 112*i*,114*i*; and the outer edge of 112*d*,114*d* of short arms 112*c*,114*c* comprises a recessed track 112*t* configured for receiving rail 112*r* on the long arm 112*a*, 114*a*;

and the short arm inner edge 112*e* features a track 112*t* slidingly interface and/or associate with a rail 114*r* featured along the corresponding short arm inner edge 114*e*. Optionally the rail and track position may be switched between corresponding parts.

Optionally the short arm 112*c*, 114*c* is about ¾ the length of long arm 112*a*,114*a*.

FIG. 4A shows a perspective long view of unitary head portion 115 showing each of the right hand portion 112 and left hand portion 114. FIG. 4C shows an end view of head portion 115.

Figure 4D:
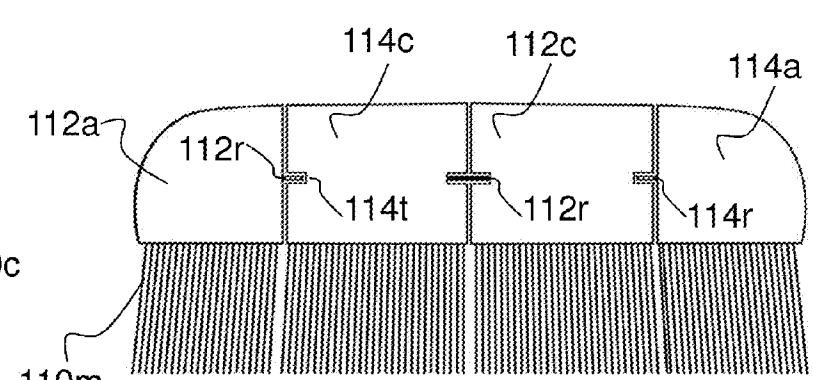
Figure 4C:
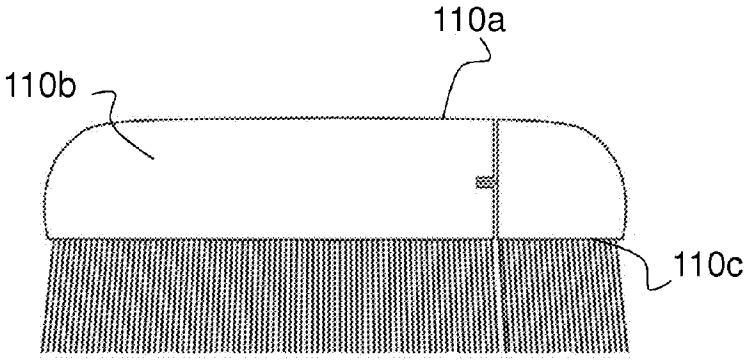

FIG. 4D is a midline cross-sectional view of head portion 115 showing the different segments of right hand portion 112 and left hand portion 114 as well as the slide coupling configuration utilizing track 112*t*,114*t* and rail 112*r*, 114*r*.

FIG. 3A-D show different view of an optional embodiment of the present invention for a cleaning device 100 that utilizes an interface layer and/or member 106. Preferably interface member 106 provides for facilitating a quick connection of the device handle assembly 102 and adaptor assembly 104 to a variety of interchangeable head portion 120 that are configured to couple with interface member 106.

Most preferably interchangeable head portions 120 has the same configuration as head portion assembly 110, as previously described, however further comprising a coupling interface for securely associating with interface member 106. Most preferably interface member 106 is configured to have the same geometric planar shape as head portions 112,114, for example as shown in FIG. 3D, so as to facilitate coupling with the upper surface of head portion 110*a*, and or interchangeable head portion 120.

Figure 3B:
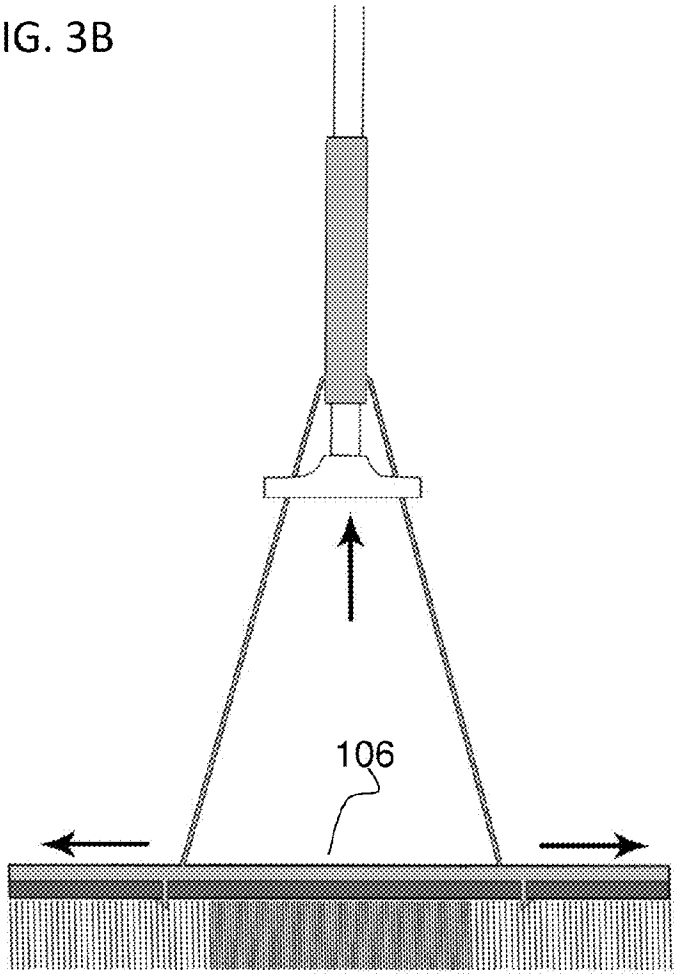
FIG. 3A-D are schematic illustrative diagrams of an exemplary cleaning device, depicted in the form of a broom, according to an optional embodiments of the present invention.
Figure 3A:
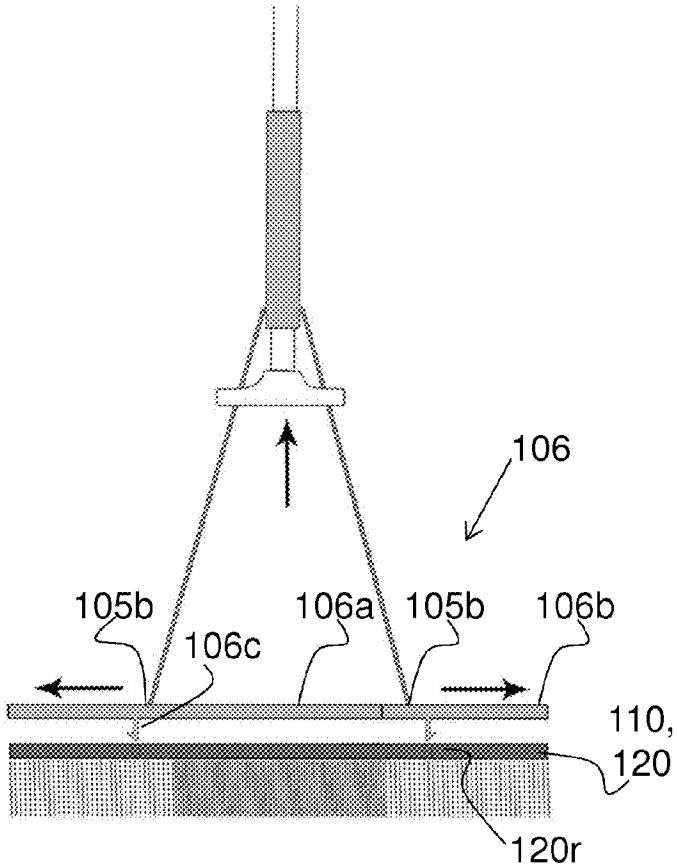
Figure 3C:
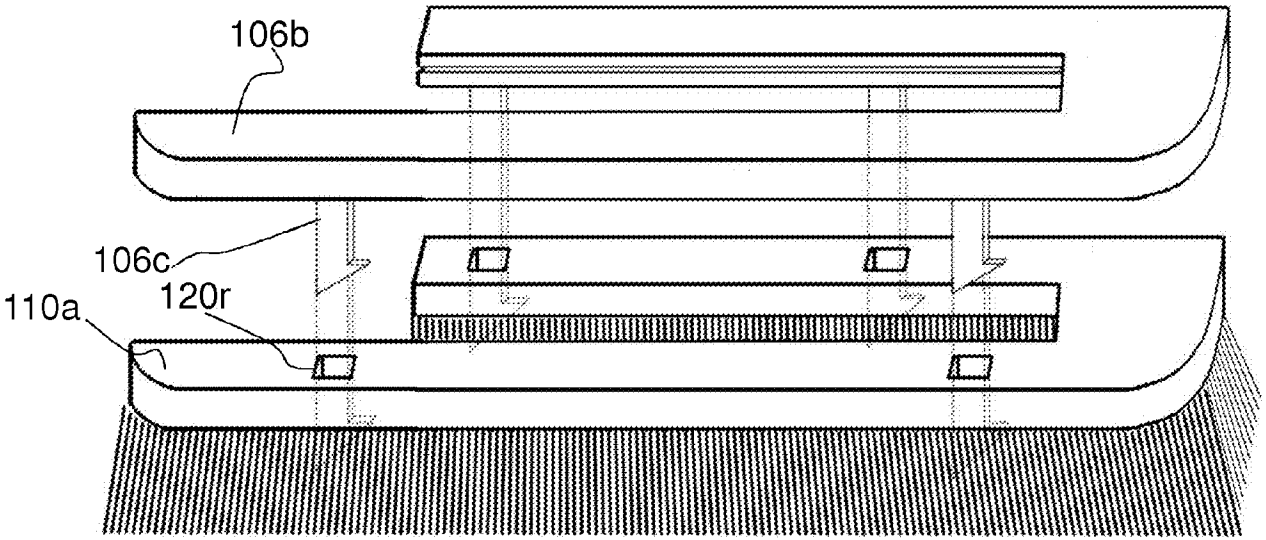
Figure 3D:
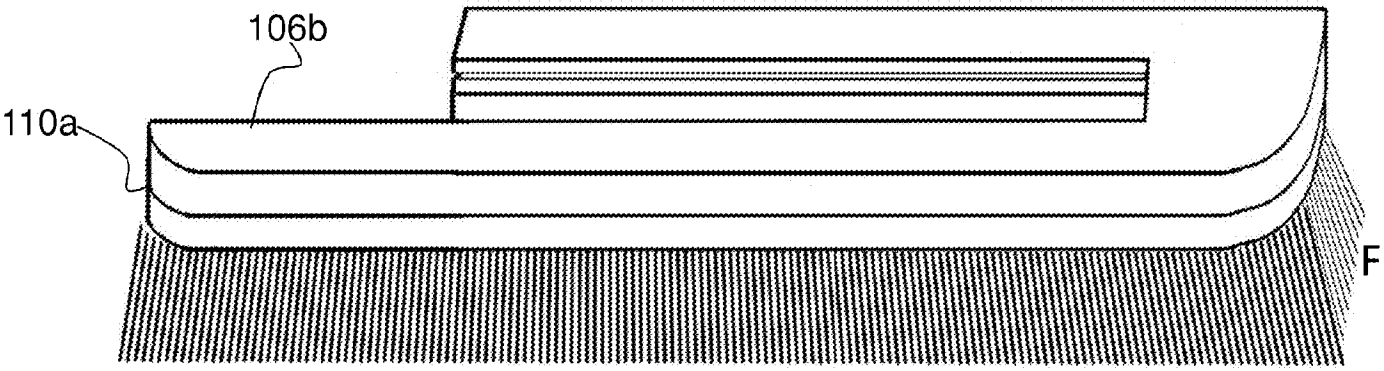

As shown in FIG. 3A-B interface member 106 is securely coupled with adaptor assembly 104, wherein at least one dimension of interface member 106 may be extended or retracted based on the position of adaptor assembly 104 to assume a narrow configuration or a wide configuration, as previously described.

Preferably interface 106 is functionally and directly associated with adaptor assembly 104 at second end 105*b* so that vertical movement of handle assembly 102, is translated/converted/adapted to horizontal movement both in interface layer 106 the head assembly 110,120 to which the interface 106 is coupled.

Preferably interface member 106 further comprises at least one and more preferably a plurality of coupling member 106*c*. Coupling members, show in FIG. 3A-D taking the form of male snap fit couplers, are provided to couple with corresponding coupling recess 120*r* disposed along the upper surface of interchangeable head portions 120.

Optionally a coupler and/or coupling interfaces may be utilized to securely couple between interface member 106 and interchangeable head portion 120.

Optionally head portion 110 may be adapted to form an interchangeable head portion 120 by introducing a coupling interface 120*c* onto upper surface 110*a* of head portion 110. Coupling interface 120*c* may be provided in any form for example including but not limited to male-female couplers, snap-fit, hook and loop, the like or any combination thereof.

FIG. 5 shows a schematic illustration of an optional coupling interface between head portion 110,120 and adaptor assembly 104. Different views are provided of an optional coupling configuration between rod second end 105*b* and upper surface 110*a* of head portion 110, wherein upper surface 110*a* comprises a coupling interface 120*c* in the form of a recess 120*r*. Optionally coupling interface 120*c* may be realized in any form capable of securely coupling with adaptor assembly 104 or rod second end 105*b*.

FIG. 6A-B shows a schematic illustrative depiction of an optional embodiment of the present invention where device 100 is coupled with an auxiliary electronic device 150, for example as previously described with respect to FIG. 1.

An optional embodiment may provide for coupling device 100 with optional auxiliary devices and/or electronic devices 150 in the form of a vacuum cleaner for example as shown in FIG. 6A or an electronic painting device as shown in FIG. 6B.

Preferably handle assembly 102, and in particular handle second portion 102*b*, may be configured to be coupled with a portion of optional auxiliary device and/or electronic devices 150, having a hose or tubing 152 that may be used to convey a flowing fluid for example air, liquid, emulsion, mixture, or gas. Hose 152 may be coupled with a handle assembly 102, for example at handle second portion 102*b*, so as to convey the flowing fluid to the cleaning head assembly 110.

Optionally handle portion 102*b* may be adapted and provided in the form of an elongated second handle portion 102*e*, having a hollow central channel to allow a flowing fluid to flow in any direction from hose 152 toward head portion 110.

Optionally and preferably elongated second handle portion 102*e* may be coupled with interface 106 at every portion thereof. FIG. 6B shows, elongated second handle portion 102*e* is shown as having a three part end where each of the three handle portion end is provided to associated with a portion of interface 106 so as to convey a flowing fluid from device 150 and onto all portion of head portion 110, 120. Optionally elongated handle 102*e* may be provided with two part end when interface 106 comprises two portions, for example similar to that depicted in FIG. 3C-D. Optionally and preferably interface 106 provides for distributing the flowing fluid being conveyed through hose 152 and elongated handle portion 102*e*, toward any portion of head portion 110, 120.

Optionally elongated handle portion 102*e* may be directly associated about a central portion of interface 106 without directly interfacing with head portion 110,120, for example as shown in FIG. 6A, in a vacuum cleaner application.

Optionally adaptor assembly 104 may be configured so as to allow plate 104*p* to slide along the length of elongated handle portion 102*e*, in the vertical direction as depicted by directional arrow 10.

Optionally auxiliary electronic device 150 may be selected from the group for example including but not limited to: vacuum cleaner, steam cleaner, pool cleaning device, pool vacuum cleaner, electronic painting device, spray paint gun, electric paint roller, electric paint brush, the like or any combination thereof.

Accordingly device 100 may be configured to be an add on device and/or a retrofit device onto an existing auxiliary and/or electronic system 150 for conveying a flowing fluid via a hose. For example a device 100 may be configured to fit with an off the shelf vacuum cleaner so as to provide an extension member and/or cleaning head and arm capable of assuming variable cleaning head widths.

While the invention has been described with respect to a limited number of embodiment, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

In the drawings, in a non-limiting depiction of optional embodiments, broken and/or dotted lines may be used to refer to optional items and/or objects and/or portions that may be utilized in some optional embodiments.

Therefore, the foregoing is considered as illustrative only of the principles of the invention. Further, since numerous modifications and changes will readily occur to those skilled in the art, it is not described to limit the invention to the exact construction and operation shown and described and accordingly, all suitable modifications and equivalents may be resorted to, falling within the scope of the invention.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the scope of the appended claims.

Citation or identification of any reference in this application shall not be construed as an admission that such reference is available as prior art to the invention.

Section headings are used herein to ease understanding of the specification and should not be construed as necessarily limiting.

While the invention has been described with respect to a limited number of embodiments, it will be appreciated that many variations, modifications and other applications of the invention may be made.

What is claimed is:

1. A device having a variable width cleaning surface, the device including a handle assembly provided in the vertical axis, an adaptor assembly and a cleaning head assembly provided in the horizontal axis, said handle assembly is functionally associated with said adaptor assembly which in turn is functionally associated with said cleaning head assembly, wherein said adaptor assembly provides for translating vertical movement along the vertical axis of said handle assembly to horizontal movement along the horizontal axis of said cleaning head assembly, said cleaning head assembly including at least two portions a first portion and second portion wherein each of said at least two portions having an upper surface, lower surface, outer side surface and inner side surface, wherein said lower surface providing a surface from which a cleaning surface extends, and wherein said first portion and said second portion forming said head assembly are associated with one another along said inner side surfaces therein allowing said at least two portions to slide relative to one another along the length of said inner side surfaces to provide the device with variable width while said cleaning surface extends from said lower surface at any variable width.

2. The device of claim 1 wherein said adaptor assembly is associated with each of said at least two portions of said cleaning head assembly along said upper surface or said outer side surface.

3. The device of claim 1 wherein said two portions are associated with one another utilizing a track and rail assembly.

4. The device of claim 1 wherein said cleaning head assembly is selected from the group consisting of: squeegee, brush, paint brush, hair brush, sweeper, mop, broom, water retention cloth, static charged cleaning cloth, water retention fabric, street sweeper, rake, garden rake, and any combination thereof.

5. The device of claim 1 wherein said handle assembly comprises at least two members that are concentrically fit with one another so as to allow a user to vertically slide a first handle portion relative to a second handle portion; wherein said second handle portion is disposed internal to said first handle portion; wherein said first handle portion and said second handle portion are individually attached to a portion of said adaptor assembly.

6. The device of claim 5 wherein handle assembly comprises at least two or more stopping positions provided to limit the movement of said first handle portion over said second handle portion.

7. The device of claim 6 wherein said stopping positions are realized in the form of a latch and recesses that are disposed along the length of said first handle portion and said second handle portion.

8. The device of claim 7 wherein said stopping positions are formed by providing said plurality of recesses along said first handle portion; and said latch is provided along said second handle portion, wherein said latch that may be repositioned between said plurality of recesses.

9. The device of claim 5 wherein the length of said second handle portion is at least twice the length of said first handle portion.

10. The device of claim 9 wherein the length of said second handle portion is at least three times the length of said first handle portion.

11. The device of claim 5 wherein said handle portions are provided in the form of elongated cylindrical rods, wherein said first handle portion has an open central channel along its length that is configured to receive said second handle portion.

12. The device of claim 5 wherein said adaptor assembly comprises at least two members including: at least one adaptor assembly rod and an adaptor assembly plate.

13. The device of claim 12 wherein said adaptor assembly comprises at least two adaptor assembly rods.

14. The device of claim 13 wherein said adaptor assembly plate is configured to securely associate with an end of the second handle portion and wherein said at least two assembly rods are configured to securely associate with the first handle portion.

15. The device of claim 14 wherein adaptor assembly plate is substantially rectangular including two parallel long edges, two parallel short edges and an upper surface wherein said upper surface is configured to receive and securely couple with an end of said second handle portion .

16. The device of claim 15 wherein said plate upper surface and said second handle portion are coupled by corresponding couplers selected from the group consisting of: threading; male to female connectors; snap fit and recess; latch and recess; any combination thereof.

17. The device of claim 16 wherein said adaptor plate further comprises at least two parallel recesses protruding through said adaptor plate surface, wherein each recess is provided for receiving at least a portion of each of said at least two adaptor assembly rods along its length and wherein said at least two parallel recesses disposed adjacent to said two parallel short edges.

18. The device of claim 17 wherein said two parallel recesses are provided in the form of a borehole across the surface of adaptor plate.

19. The device of claim 18 wherein said borehole is provided at an angle.

20. The device of claim 19 wherein said borehole angle is up to 90 degrees relative to a normal of the adaptor plate upper surface .

21. The device of claim 13 wherein said at least two adaptor assembly rods having a first end, an elongated shaft and a second end, a) wherein said shaft is configured to be received within an adaptor plate rod recess; and b) wherein said first end is configured to be pivotally coupled with said first handle portion wherein said rod is pivoted with respect to said first handle portion; and c) wherein said second end is configured to associate with said cleaning head assembly.

22. The device of claim 21 wherein coupling between said first end and said first handle portion is mediated with a coupler selected from the group consisting of a hinge, ball and socket, any combination thereof.

23. The device of claim 21 wherein said adaptor assembly comprises a plurality of stopping points realized in the form of notches along the length of said rods and wherein said adaptor plate may be fit with a stopping or holding member provided to hold said adaptor plate at a stopping point along said elongated shaft.

24. The device of claim 1 wherein said cleaning head assembly is provided in the form of a brush selected from the group consisting of: paint brush, tooth brush, hair brush, any combination thereof.

25. The device of claim 1 wherein a portion of said handle assembly is configured so as to allow association with auxiliary electronic devices selected from the group consisting: of vacuum cleaner, steam cleaner, pool cleaning device, pool vacuum cleaner, electronic painting device, spray gun, electric paint roller, electric paint brush, any combination thereof.

26. The device of claim 1 wherein said at least two portions of said cleaning head assembly are characterized in that they are geometric chiral bodies of the other, each portion forming a 'U-like' polygonal body comprising a rectangular base integral with two extending arms including a long arm and a short arm, said long arm having an outer edge and an inner edge; and wherein said short arm comprises an outer edge and an inner edge; wherein said long arm inner edge is configured to slidingly interface with said short arm outer edge of each of said at least two portions; and wherein said short arm inner edge of each of said at least two portions is configured to slidingly interface with one another.

27. A broom having a variable width cleaning surface, the broom including a handle assembly and an adaptor assembly configured to move along the vertical axis and a broom head assembly configured to assume at least two configuration along a horizontal axis including a closed configuration an open configuration, wherein said handle assembly is functionally associated with said adaptor assembly which in turn is functionally associated with said broom head assembly, wherein said adaptor assembly provides for translating vertical movement of said handle assembly along the vertical axis to horizontal movement of said broom head assembly along the horizontal axis, characterized in that said broom head assembly includes:

a) at least two broom head portions that are coupled with one another to form a unitary broom head having variable width along the horizontal plane wherein said variable width is controllable with the movement of said handle assembly along the vertical axis;

b) the unitary broom head including:

i) a planar body comprising an upper surface and a lower surface;

ii) wherein said upper surface is provided for associating with a portion of said adaptor assembly;

iii) wherein said lower surface features broom brush bristles;

iv) wherein each of said at least two broom head portions are configured to slide relative to one another along at least one side surface so as to allow said broom head to assume said variable width along the horizontal axis, v) and wherein said at least two broom head portions are characterized in that they are geometric chiral bodies of the other, each of said at least two broom head portions forming 'U-like' polygonal body comprising a rectangular base integral with two extending arms including a long arm and a short arm, said long arm having an outer edge and an inner edge; and wherein said short arm comprises an outer edge and an inner edge; wherein said long arm inner edge of each of said at least two broom head portions is configured to slidingly interface with said short arm outer edge of each of said at least two broom head portions; and wherein said short arm inner edge of each of said at least two broom head portions is configured to slidingly interface with one another.

28. The broom of claim 27 wherein in the wide configuration the broom head has a length equal to about twice the length of said long arm and in the narrow configuration the cleaning head has a length equal to about the length of said long arm.

29. The broom of claim 27 wherein said broom head comprises at least two broom head portions include a right hand broom head portion and a left hand broom head portion, characterized in that said right hand broom head portion and said left hand broom head portion are intertwined with one another.

30. The broom of claim 27 wherein said at least two broom head portions are slidingly associated with one another by way of utilizing corresponding track and rail system.

31. The broom of claim 27 wherein the edges of said long arms and said short arms may comprise corresponding track and rail.

32. The broom of claim 27 wherein said short arm is about ¾ the length of said long arm.

33. The device broom of claim 27 wherein said adaptor assembly includes at least two adaptor assembly rods having a first end, an elongated shaft and a second end; and wherein said upper surface is directly associated with said adaptor assembly at said second end.

* * * * *